US005511393A

United States Patent [19]

Hu

[11] Patent Number: 5,511,393

[45] Date of Patent: Apr. 30, 1996

[54] SINKER SYSTEM FOR KNITTING FACE-LOOP AND REVERSE-LOOP FABRICS AS WELL AS FACE-LOOP JACQUARD AND REVERSE-LOOP JACQUARD FABRICS

[76] Inventor: Chao-San Hu, No. 333, Chien Ching Street, Su Lin, Taipei Hsien, Taiwan

[21] Appl. No.: 392,326

[22] Filed: Feb. 22, 1995

[51] Int. Cl.[6] ..... D04B 35/00

[52] U.S. Cl. ..... 66/93; 66/92; 66/104

[58] Field of Search ..... 66/92, 93, 107, 66/90, 8, 9 R, 31

[56] References Cited

U.S. PATENT DOCUMENTS

| | | | |
|---|---|---|---|
| 3,293,887 | 12/1966 | Crawford | 66/93 X |
| 3,703,819 | 11/1972 | Townsend et al. | 66/93 |
| 4,103,518 | 8/1978 | Lombardi et al. | 66/104 |
| 4,535,608 | 8/1985 | Plath et al. | 66/93 X |
| 4,665,718 | 5/1987 | Jelinek et al. | 66/93 X |
| 4,955,211 | 9/1990 | Neher | 66/93 X |
| 4,989,421 | 2/1991 | Schmidt | 66/93 X |

FOREIGN PATENT DOCUMENTS

| | | | |
|---|---|---|---|
| 472506 | 2/1992 | European Pat. Off. | 66/92 |
| 2038376 | 7/1980 | United Kingdom | 66/92 |

*Primary Examiner*—John J. Calvert
*Attorney, Agent, or Firm*—Bacon & Thomas

[57] ABSTRACT

A sinker system for a knitting machine, including a sinker plate holder having a master sinker slot and an auxiliary sinker slot; a master sinker having a throat, a nose, a flank, and a sinker butt; a face-loop sinker of size fitting the master sinker slot and having the nose divided into the upper nose and the lower nose by a parting rod; a reverse-loop sinker of configuration fitting the face-loop sinker with the upper throat shallower than that of the face-loop sinker; and a jacquard sinker having a stepped nose; and wherein a face-loop fabric can be obtained by matching the master sinker with the face-loop sinker and reciprocating them in the master sinker slot and auxiliary sinker slot on the sinker plate holder respectively; a reverse-loop fabric can be obtained by matching the master sinker with the reverse-loop sinker and reciprocating them in the master sinker slot and the auxiliary sinker slot on the sinker plate holder respectively; a face-loop jacquard fabric can be obtained by matching the jacquard sinker with the face-loop sinker and reciprocating them in the master sinker slot and auxiliary sinker slot on the sinker plate holder respectively; a reverse-loop jacquard fabric can be obtained by matching the jacquard sinker with the reverse-loop sinker and reciprocating them in the master sinker slot and auxiliary sinker slot on the sinker plate holder respectively.

1 Claim, 5 Drawing Sheets

SINKER SYSTEM FOR KNITTING FACE-LOOP AND REVERSE-LOOP FABRICS AS WELL AS FACE-LOOP JACQUARD AND REVERSE-LOOP JACQUARD FABRICS

BACKGROUND OF THE INVENTION

According to researches, manual knitting apparatus were developed during the fourth and fifth centuries for knitting knitted fabrics manually. Since the Industrial Revolution, various mechanical knitting machines were developed and intensively used to replace conventional manual knitting apparatus. In 1816, Marc Brunnel invented a sinker wheel machine using sinkers to match with needles in knitting knitted fabrics. Nowadays, most automatic knitting machines use sinkers to hold the fabric and the yarns, and knitting needles are reciprocated vertically to hook up or release the yarns while sinkers are reciprocated horizontally. Therefore, the design of the sinkers in a knitting machine has concern with the quality and pattern of the knitted fabric. However, because regular knitting machines use only one sinker in one knitting slot, the sinkers of the knitting machines cannot positively hold down the fabric and the yarns. For example, a towelling is made by knitting a base yarn and a face yarn in each knitting slot, and the respective sinker is operated to hold down the fabric and the face yarn only, therefore the base yarn tends to float, causing a different color of yarn shown on the surface of the fabric. Furthermore, different sinkers may be used for knitting face-loop towelings and reverse-loop towelings. However, one a knitting machine is to be changed from the face-loop knitting to the reverse-loop knitting, the sinkers and sinker plate holder as well as parts of the machine must be changed or modified. Besides, these sinkers do not allow the machines to knit a cutting motif towelling of two or more colors. Besides, the knitting of a jacquard fabric is performed by means of the operation of specific jacquard sinkers, however, these jacquard sinkers cannot be replaced by the aforesaid sinkers for face-loop or reverse-loop knitting.

FIG. 1 shows a sinker for knitting machines according to the prior art. The sinker comprises a throat 10 for retaining the fabric, a nose 20, which holds down the fabric during the up stroke of the knitting needle, a flank 30, which forces the (face) yarn into a new loop during the down stroke of the knitting needle, and a sinker butt 40, which is moved in the respective sinker slot in the sinker plate holder. As the sinker can only hold down the face yarn, the base yarn will displace during the knitting operation. Furthermore, the sinker allows the knitting needle to knit face loops only.

SUMMARY OF THE INVENTION

The present invention has been accomplished under the circumstances in view. It is therefore the principal object of the present invention to provide a sinker system for a knitting machine which is suitable for knitting face-loop and reverse-loop fabrics as well as face-loop jacquard and reverse-loop jacquard fabrics. According to the preferred embodiment of the present invention, the sinker system comprises a sinker plate holder having a master sinker slot and an auxiliary sinker slot; a master sinker having a throat, a nose, a flank, and a sinker butt; a face-loop sinker of size fitting the master sinker slot and having the nose divided into the upper nose and the lower nose by a parting rod; a reverse-loop sinker of configuration fitting the face-loop sinker with the upper throat shallower than that of the face-loop sinker; and a jacquard sinker having a stepped nose; and wherein a face-loop fabric can be obtained by matching the master sinker with the face-loop sinker and reciprocating them in the master sinker slot and auxiliary sinker slot on the sinker plate holder respectively; a reverse-loop fabric can be obtained by matching the master sinker with the reverse-loop sinker and reciprocating them in the master sinker slot and the auxiliary sinker slot on the sinker plate holder respectively; a face-loop jacquard fabric can be obtained by matching the jacquard sinker with the face-loop sinker and reciprocating them in the master sinker slot and auxiliary sinker slot on the sinker plate holder respectively; a reverse-loop jacquard fabric can be obtained by matching the jacquard sinker with the reverse-loop sinker and reciprocating them in the master sinker slot and auxiliary sinker slot on the sinker plate holder respectively.

DETAILED DESCRIPTION OF THE PREFERRED EMBODIMENT

Figure 1:
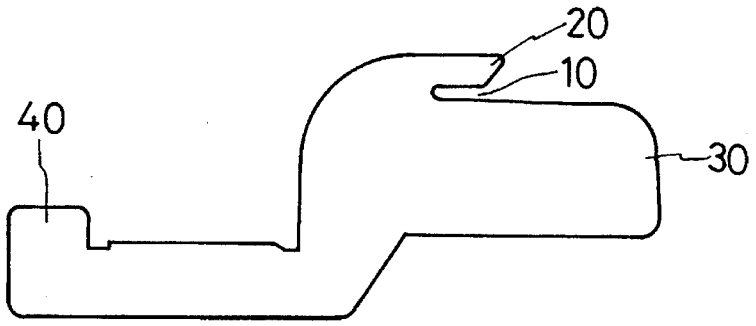
FIG.1 (PRIOR ART)
FIG. 1 shows a sinker according to the prior art.
Figure 2:
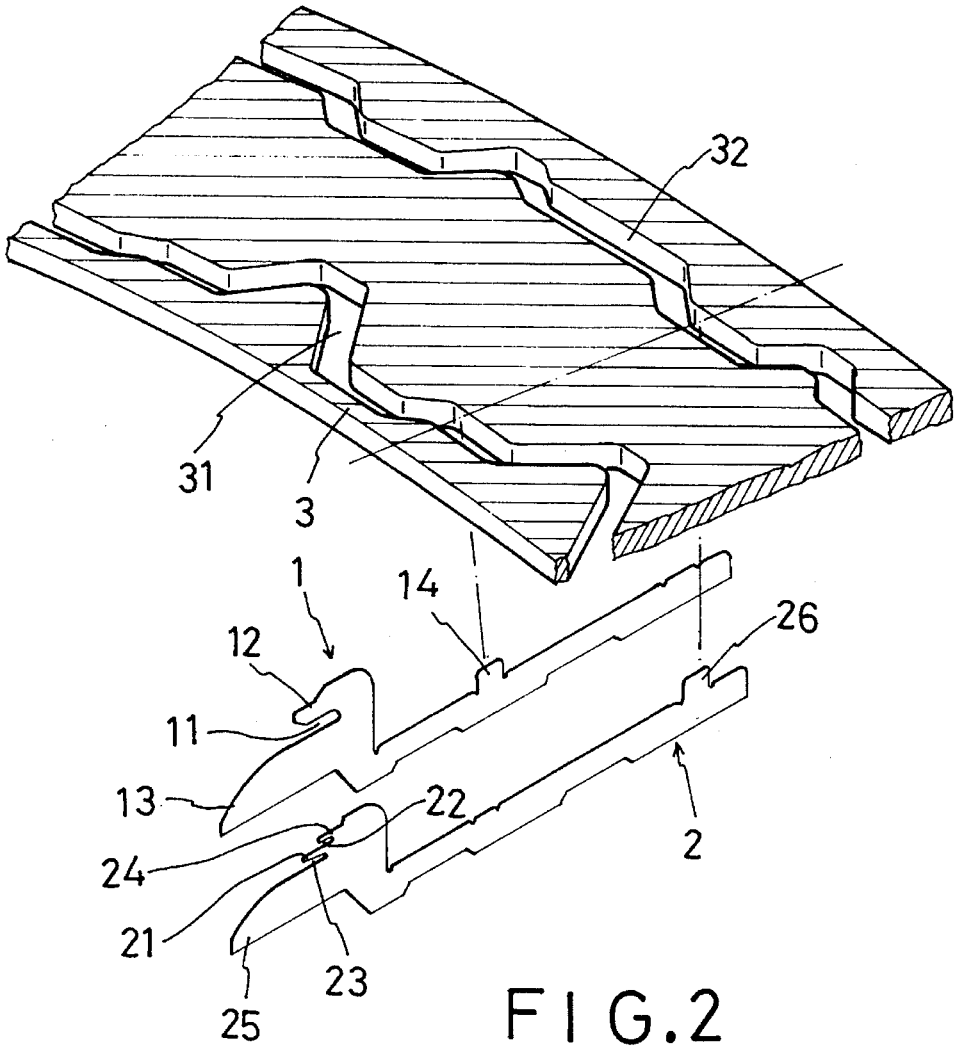
FIG. 2 is an exploded view of a face-loop sinker set according to the present invention.

Referring to FIG. 2, a sinker system in accordance with the present invention is generally comprised of a master sinker 1, a face-loop sinker 2, a sinker plate holder 3, a reverse-loop sinker 4, and a jacquard sinker 5.

The master sinker 1 is made from a smooth, flat metal plate comprising a throat 11 for retaining the fabric, a nose 12 for holding down the fabric during the up stroke of the knitting needle, a flank 13 for forcing the yarn into a new loop during the down stroke of the knitting needle, and a sinker butt 14, which is to be moved in the main sinker slot 31 on the sinker plate holder 3 to control the length of the loop.

The face-loop sinker 2 is made from a smooth, flat metal plate comprising an upper throat 22 and a lower throat 23 separated by a parting rod 21 and similar to the throat 11 on the master sinker 1, a nose 24 located adjacent to the nose 12 on the master sinker 1, a flank 25 similar to the flank 13 of the master sinker 1, and a sinker butt 26, which is moved in the auxiliary sinker slot 32 on the sinker plate holder 3 to hold the base yarn during the face-loop knitting.

The sinker plate holder 3 comprises a master sinker slot 31, which receives the sinker butt 14 of the master sinker 1, and an auxiliary sinker slot 32, which receives the sinker butt 26 of the face-loop sinker 2.

Figure 3:
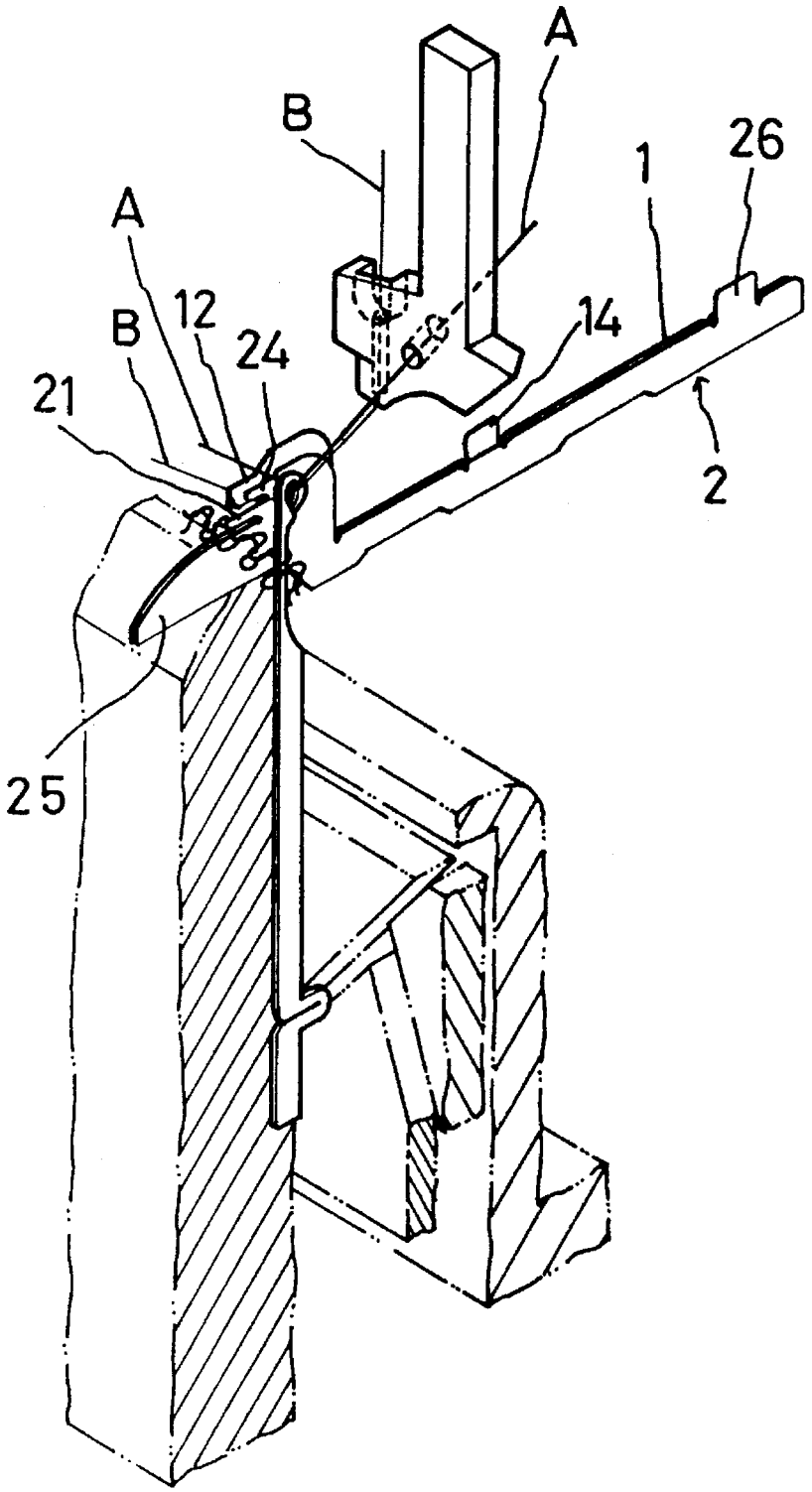
FIG. 3 shows the face-loop sinker set of FIG. 2 operated to knit face loop.

Referring to FIG. 3, the master sinker 1 and the face-loop sinker 2 are closely attached together side by side, and the sinker butts 14 and 26 are respectively inserted in to the master sinker slot 31 and the auxiliary sinker slot 32 of the sinker plate holder 3. When the face yarn A is guided out of the respective thread hole and hung on the noses 12 and 24 to form a loop, the base yarn B is retained in place by the upper throat 22, and the fabric is retained in place by the lower throat 23. Because the base yarn B is retained by the upper throat 22 beneath the face yarn A, the problem of float is eliminated during the face-loop knitting.

Figure 4:
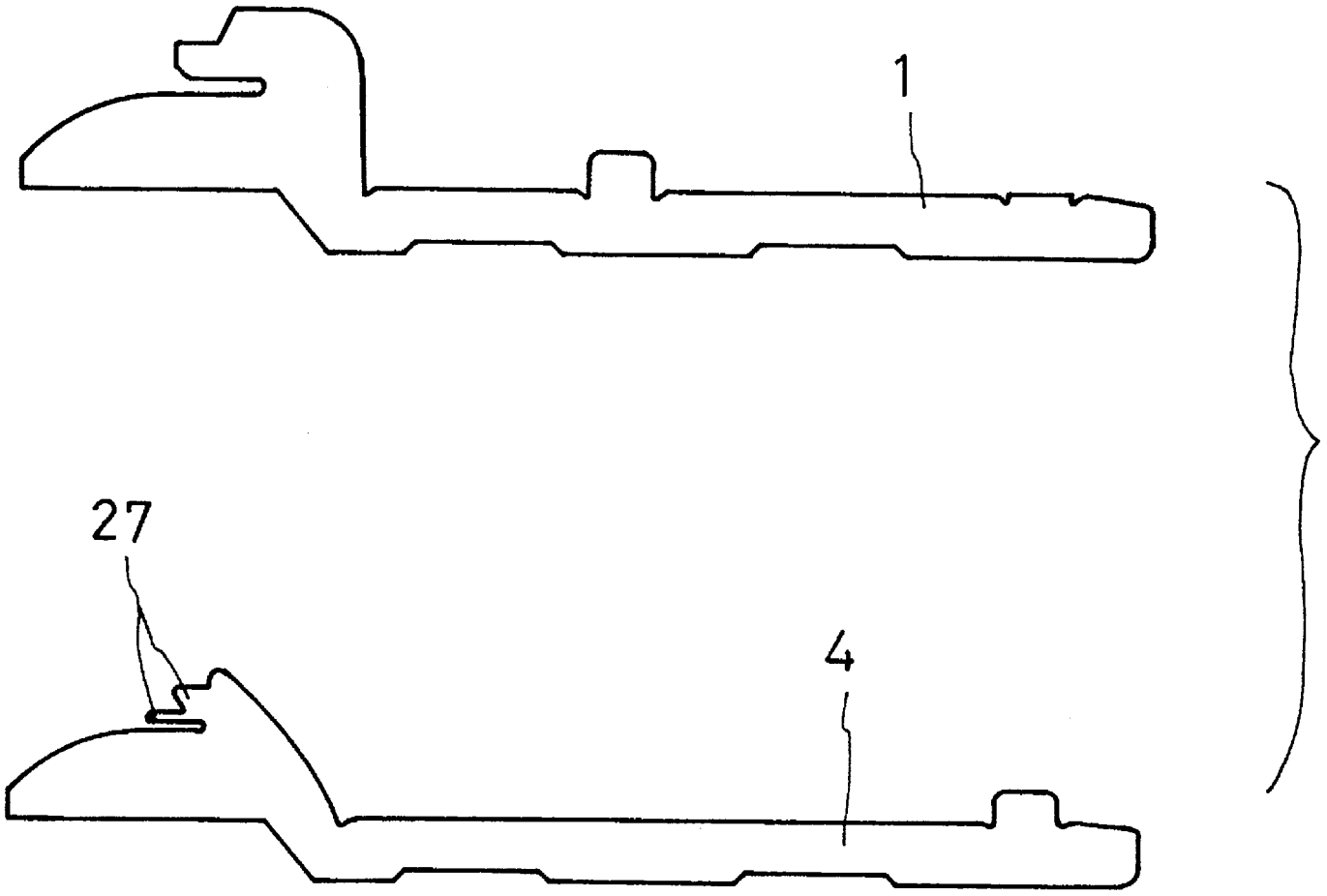
FIG. 4 shows a reverse-loop sinker set according to the present invention.

Referring to FIG. 4, when to perform a plain color reverse-loop knitting, the reverse-loop sinker 4 is installed to replace the face-loop sinker 2 and to match with the master sinker 1. The structure of the reverse-loop sinker 4 is similar to the face-loop sinker 2, however the depth of the upper throat 22 of the face-loop sinker 2 is relatively deeper than that of the upper throat 27 of reverse-loop sinker 4. The reverse-loop sinker 4 is operated in the same manner as the face-loop sinker 2.

Figure 5:
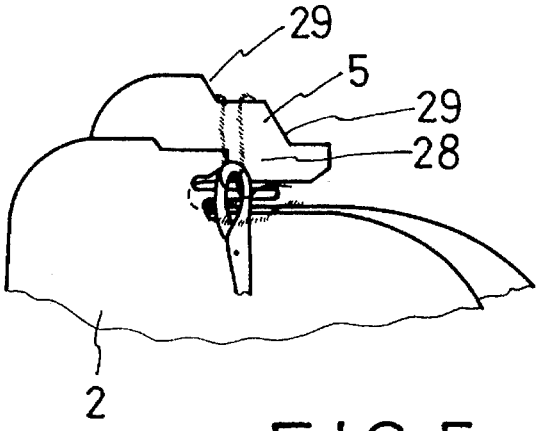
FIGS. 5, 6, and 7 show the face-loop jacquard knitting according to the present invention.
Figure 6:
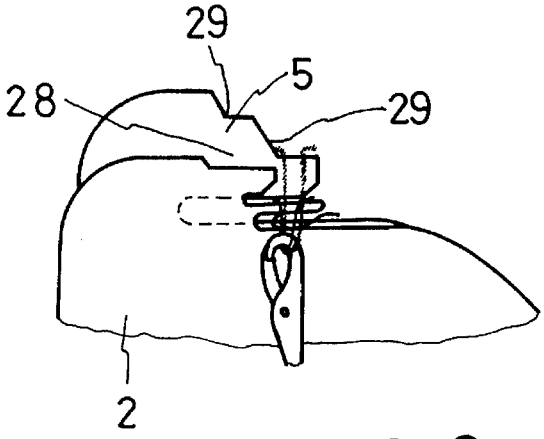
Figure 7:
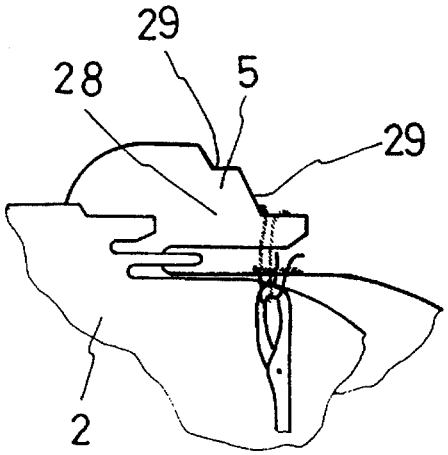

FIGS. 5, 6, and 7 show the face-loop jacquard knitting according to the present invention, in which the aforesaid jacquard sinker 5 is installed to match with the face-loop sinker 2 and to replace the master sinker 1. The nose 28 of the jacquard sinker 5 is stepped at 29 for hanging face loops of different colors. When different colors of yarns are hung on the jacquard sinker 5 and the face-loop sinker 2 (See FIG. 5), the jacquard sinker 5 is moved backwards and at the same time, the knitting needle is moved downwards to the second-layer position (see FIG. 6). When the loops are formed, the base yarn sinker is moved away (see FIG. 7). Therefore, when the jacquard sinker 5 and the face-loop sinker 2 are reciprocated in the sinker plate holder 3, a face-loop jacquard towelling is knitted.

Figure 8:
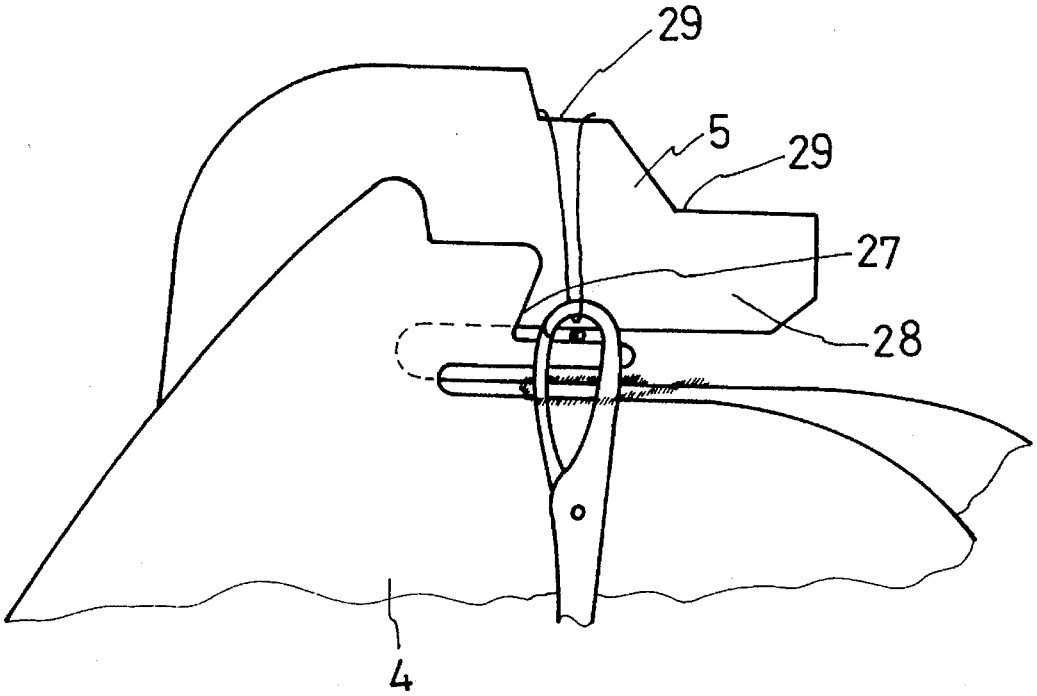
FIGS. 8 and 9 show the reverse-loop jacquard knitting according to the present invention.
Figure 9:
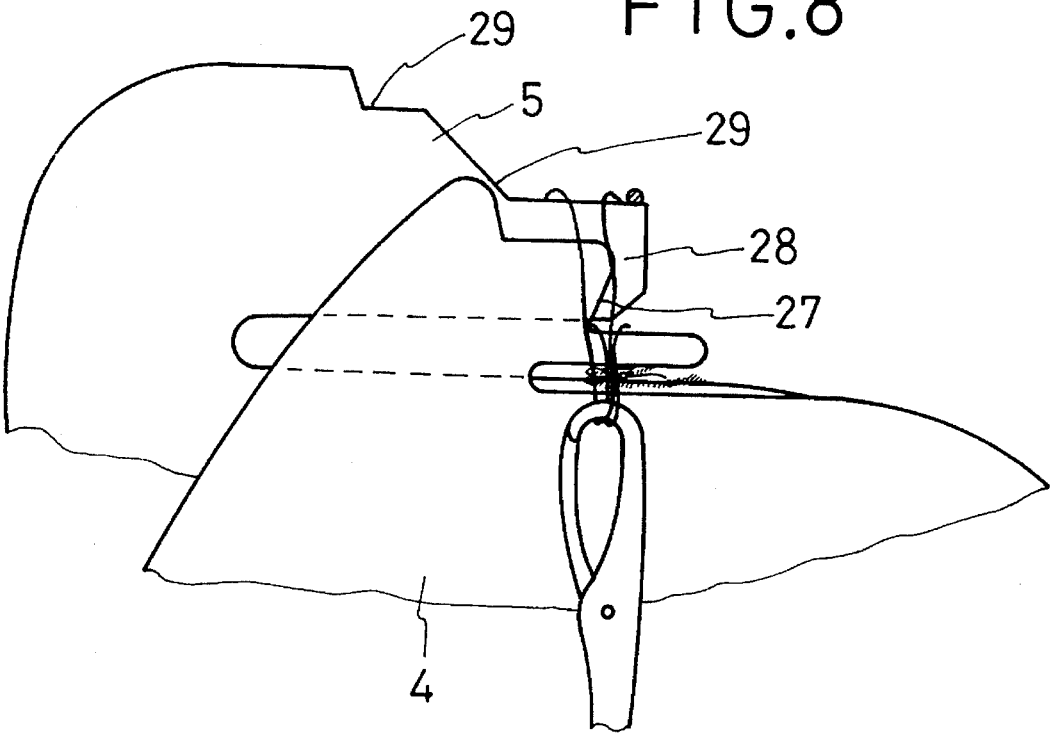

FIGS. 8 and 9 show the reverse-loop jacquard knitting according to the present invention, in which the aforesaid jacquard sinker 5 is installed to match with the reverse-loop sinker 4 and to replace the master sinker 1. When the jacquard sinker 5 and the reverse-loop sinker 4 are reciprocated in the sinker plate holder 3, a reverse-loop jacquard towelling is knitted.

As indicated, different products can be achieved by matching different sinkers, i.e., 1) A face-loop fabric can be obtained by matching the master sinker 1 with the face-loop sinker 2;
2) A reverse-loop fabric can be obtained by matching the master sinker 1 with the reverse-loop sinker 4;
3) A face-loop jacquard fabric can be obtained by matching the jacquard sinker 5 with the face-loop sinker 2; and
4) A reverse-loop jacquard fabric can be obtained by matching the jacquard sinker 5 with the reverse-loop sinker 4.

It is to be understood that the drawings are designed for purposes of illustration only, and are not intended as definition of the limits and scope of the invention disclosed.

What is claimed is:

1. A sinker system for a knitting machine having a knitting needle, comprising:

a) a movable sinker plate holder having a master sinker drive slot and an auxiliary sinker drive slot; and, b) at least one pair of sinkers located adjacent to each other, each sinker of the pair having a sinker butt, the sinker butt of one of the pair of sinkers engaged with the master sinker drive slot and the sinker butt of the other of the pair of sinkers engaged with the auxiliary sinker drive slot such that movement of the sinker plate causes movement of the sinkers of the a least one pair of sinkers, the at least one pair of sinkers comprising two different sinkers selected from the group of sinkers consisting of:

i) a master sinker comprising a smooth, flat metal plate having a throat for retaining a fabric, a nose for hanging a yarn and holding down the fabric during an up stroke of the knitting needle, and a flank for forcing the yarn into a new loop during a down stroke of the knitting needle, movement of the master sinker controlling the length of a loop;

ii) a face-loop sinker comprising a smooth, flat metal plate having an upper throat and a lower throat separated by a parting rod, a nose for hanging the yarn and holding down the fabric during an up stroke of the knitting needle and a flank for forcing the yarn into a new loop during a down stroke of the knitting needle, the face-loop similar holding a base yarn during face-loop knitting;

iii) a reverse-loop sinker comprising a smooth, flat metal plate having a shallow upper throat and a lower throat separated by a parting rod, a nose for hanging the yarn and holding down the fabric during an up stroke of the knitting needle, and a flank for forcing the yarn into a new loop during a down stroke of the knitting needle, the reverse-loop sinker holding the base yarn during reverse-loop knitting, the depth of the upper throat of said reverse-loop sinker being shallower than the depth of the upper throat of said face-loop sinker; and iv) a jacquard sinker comprising a smooth, flat metal plate having a throat for retaining the fabric, a stepped nose for hanging yarns and holding down the fabric during the up stroke of the knitting needle, and a flank for forcing yarns into loops during the down stroke of the knitting needle, movement of the jacquard sinker controlling the length of the loop;

wherein a face-loop fabric is knitted by using said master sinker and said face-loop sinker as the pair of sinkers and reciprocating them by said master sinker slot and auxiliary sinker slot, respectively on said sinker plate holder; a reverse-loop fabric is knitted by using said master sinker and said reverse-loop sinker as the pair of sinkers and reciprocating them by said master sinker slot and said auxiliary sinker slot respectively on said sinker plate holder; a face-loop jacquard fabric is knitted by using said jacquard sinker and said face-loop sinker as the pair of sinkers and reciprocating them by said master sinker slot and auxiliary sinker slot respectively on said sinker plate holder; and a reverse-loop jacquard fabric is knitted by using said jacquard sinker and said reverse-loop sinker as the pair of sinkers and reciprocating them in said master sinker slot and auxiliary sinker slot respectively on said sinker plate holder.

* * * * *